United States Patent [19]

Hou

[11] Patent Number: 5,070,753

[45] Date of Patent: Dec. 10, 1991

[54] MECHANISM FOR IMPARTING OSCILLATING MOVEMENT TO AN ORNAMENTAL OBJECT

[76] Inventor: Jack Hou, P.O. Box 78-5, Taipei, Taiwan

[21] Appl. No.: 505,427

[22] Filed: Apr. 6, 1990

Related U.S. Application Data

[63] Continuation-in-part of Ser. No. 318,684, Mar. 3, 1989.

[51] Int. Cl.[5] ..... G10F 1/06

[52] U.S. Cl. ..... 84/95.2

[58] Field of Search ..... 84/94.2, 95.2

[56] References Cited

U.S. PATENT DOCUMENTS

| | | | |
|---|---|---|---|
| 1,517,168 | 11/1924 | Rogers . | |
| 1,876,753 | 9/1932 | Reuge | 84/95.2 |
| 2,570,778 | 10/1951 | De Vane . | |

FOREIGN PATENT DOCUMENTS

| | | | |
|---|---|---|---|
| 577296 | 5/1933 | Fed. Rep. of Germany | 84/55.2 |
| 254835 | 1/1949 | Switzerland . | |
| 298766 | 7/1954 | Switzerland | 84/95.2 |
| 334351 | 1/1959 | Switzerland | 84/95.2 |

*Primary Examiner*—Brian W. Brown

*Attorney, Agent, or Firm*—Bacon & Thomas

[57] ABSTRACT

Uniform oscillating movement is imparted to a toy by a tappet rod from an output shaft of a music box drive source by a connecting rod having its opposite ends pivotally connected to a cam assembly on the output shaft and a cam follower arm on the tappet rod to define two pivot axes therewith, whereby rotation of the cam assembly imparts an oscillating movement to the tappet rod at a uniform speed through both halves of each oscillation.

15 Claims, 10 Drawing Sheets

MECHANISM FOR IMPARTING OSCILLATING MOVEMENT TO AN ORNAMENTAL OBJECT

RELATED APPLICATION

This is a Continuation-in-Part application of Ser. No. 07/318,684 to HOU filed on Mar. 3 1989.

BACKGROUND OF THE INVENTION

1. Field of the Invention

The present invention generally involves the field of technology pertaining to animated toys and ornaments. More specifically, the invention relates to an improved mechanism for imparting an oscillating movement to a toy or ornament from the output of a power drive source, such as a music box mechanism.

2. Description of the Prior Art

It is known to impart oscillating movements to ornamental objects, such as dolls, supported on a housing by a windup or electric music producing mechanism. This is conventionally realized by providing the power output shaft of the mechanism with a rotating cam assembly having a cam element. A tappet rod supporting the object is rotatably journalled through a wall of the housing and secured to a cam follower arm. The cam element is slidably disposed within a slot provided in the follower arm so that rotation of the cam assembly by the output shaft imparts an oscillating movement to the tappet rod about its longitudinal axis and thereby cause a corresponding oscillation of the object supported thereon.

A conventional oscillating mechanism of this type is based on the concept of a sliding block disposed within a sliding groove, and is also known as a rocker arm reciprocating mechanism. The concept is known in the machine tool industry and is utilized in a shaper machine for cutting a rapidly reciprocating workpiece.

Such a mechanism is inherently incapable of providing a uniform and balanced oscillating-movement to an ornamental object. This is because the geometric relationship between the cam follower arm and its associated cam assembly describes two arcuate paths travelled by the cam element, the beginning and end of the paths being defined by radii extending outwardly from the cam assembly axis of rotation and intersecting the cam element at two points establishing the extreme limits of the oscillation. Since the cam element must travel along a longer arcuate path during the forward half of the oscillation than the arcuate path required for completing the return half of the movement, it is therefore apparent that each half of the oscillation is completed over a different time interval and speed. This results in a nonuniform oscillation of the object.

SUMMARY OF THE INVENTION

It is an object of the invention to provide an improved mechanism for imparting an oscillating movement to an ornamental object such as a doll or the like.

It is another object of the invention to provide a mechanism capable of imparting a balanced and stable oscillating movement to an ornamental object wherein each half of the movement is completed over the same time interval and speed.

It is a further object of the invention to provide an improved oscillating mechanism for a music box whereby an ornamental object associated therewith may be oscillated in a uniform and stable manner during operation of the music producing mechanism.

These and other objects of the invention are realized by providing an oscillating mechanism which includes a connecting rod having one end pivotally connected to the cam element of a cam assembly and its other end pivotally connected to a cam follower arm. The cam assembly is rotated by the power output shaft of a music box mechanism and the cam follower arm is connected to a tappet rod that is journalled for rotation through the wall of a housing within which the music box and oscillating mechanisms are disposed. By virtue of this configuration, rotation of the cam assembly imparts a uniform oscillating movement to the tappet rod so that both halves of each complete oscillation occurs at the same speed and over the same time interval. This same uniform movement is imparted to an ornamental object supported on the tappet rod.

Other objects, advantages and features of the invention shall become apparent from the following detailed description of a preferred embodiment thereof when considered in conjunction with the drawings wherein like reference characters refer to corresponding parts in the several views.

DETAILED DESCRIPTION OF THE PREFERRED EMBODIMENT

Figure 1:
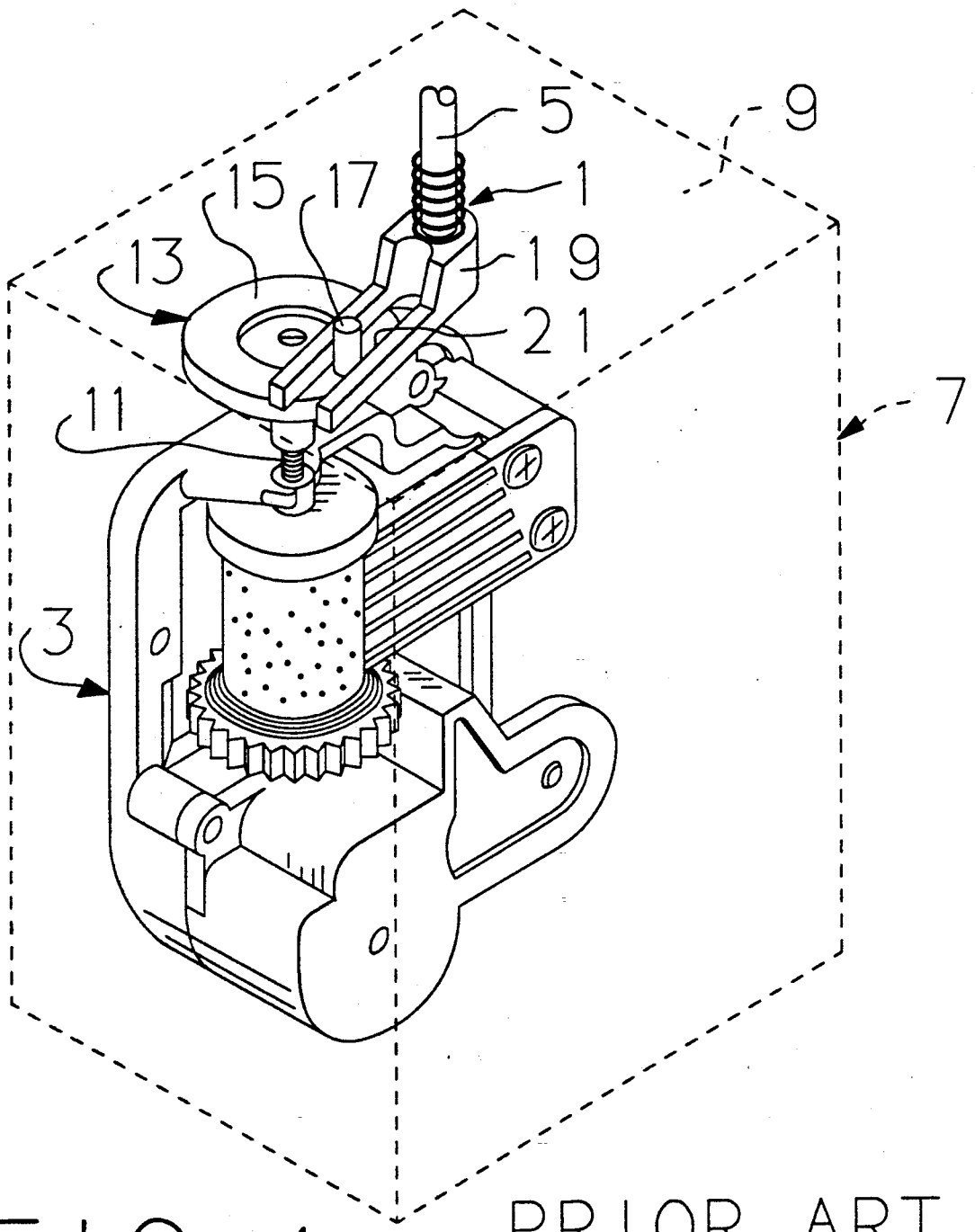
FIG. 1 PRIOR ART
FIG. 1 is a perspective view of a conventional oscillating mechanism driven by a music box mechanism for oscillating a tappet rod, the oscillating and music box mechanisms being disposed within a housing indicated by phantom lines.

With initial reference to FIG. 1, there is shown a conventional oscillating mechanism 1 driven by a music box mechanism 3 for oscillating an ornamental object (not shown), such as a doll or the like, mounted on an upper exterior end of a tappet rod 5. Mechanisms 1 and 3 are contained within a housing, shown generally at 7, with tappet rod 5 being journalled for rotation through an upper wall 9 of housing 7 in a manner known in the art.

Music box mechanism 3 includes a power output shaft 11 onto which a cam assembly 13 is rotatably secured. Assembly 13 includes a cam wheel 15 the center of which is coaxial with the axis of rotation of output shaft 11, and an eccentrically mounted cam element 17 which extends upwardly from wheel 15. Mechanism 1 also includes a cam follower arm 19 provided with a longitudinal slot 21 within which element 17 is slidably engaged. As apparent from FIG. 1, the lower end of tappet rod 5 extends into the interior of housing 7 and is secured to an end of arm 19. Thus, the operation of music box 3, either through a windup mechanism or an electric motor, rotates output shaft 11, thereby rotating cam wheel 15. This also causes cam element 17 to rotate about the axis of rotation of shaft 11, resulting in a back and forth oscillation of follower arm 19 because of its sliding engagement with element 17. This oscillating movement is transmitted to tappet rod 5 and causes a corresponding movement to the ornamental object mounted thereon.

Figure 2:
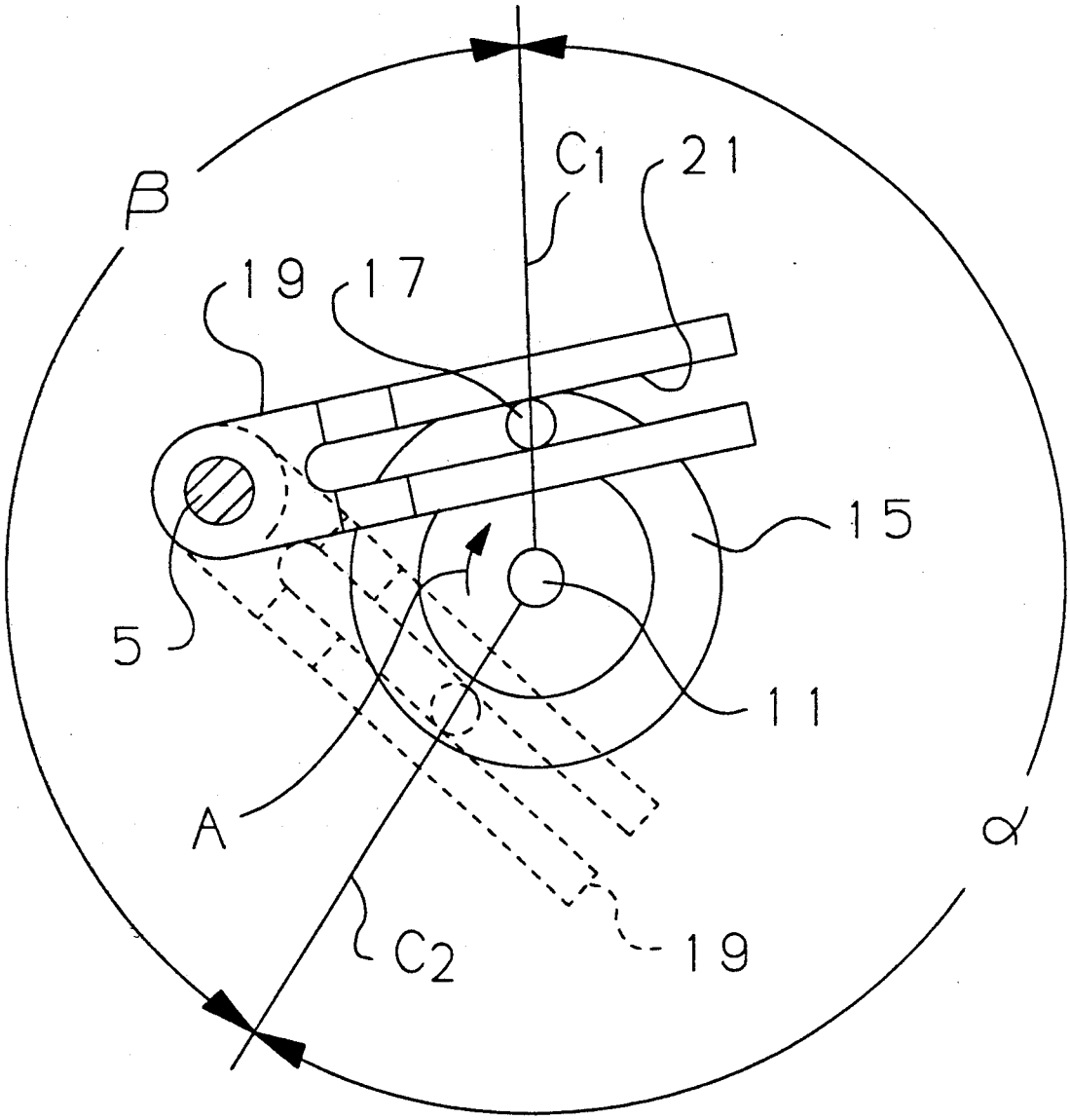
PRIOR ART FIG. 2
FIG. 2 is a partial top view of the oscillating mechanism shown in FIG. 1, and particularly depicting the geometric relationship between the cam assembly and cam follower arm in producing the oscillating movement.

The nature and geometric configuration of mechanism 1 shall now be described with reference to FIG. 2. The oscillating movement latter by output shaft 11 covers a path between two terminal points $C_1$ and $C_2$ which define the outer limits of travel for arm 19, and thus the degree of oscillation imparted to tappet rod 5. Points $C_1$ and $C_2$ fall within respective radii extending from the axis of rotation of shaft 11 and through the center of element 17 in both positions. It is therefore evident that upon rotation of shaft 11 in the clockwise direction indicated by arrow A. the length of the arcuate path travelled by pin 17 from $C_1$ to $C_2$. indicated by alpha ($\alpha$) exceeds the length of the path from $C_2$ back to $C_1$ as indicated by beta ($\beta$). Because of this difference, the forward movement of arm 19. when element 17 is traversing path alpha ($\alpha$), requires a longer interval of time and thus occurs at a slower speed than the return movement when element 17 is travelling path beta ($\beta$) in completing a full oscillation. This disparity causes a nonuniform oscillating movement to the ornamental object supported on tappet rod 5.

Figure 3:
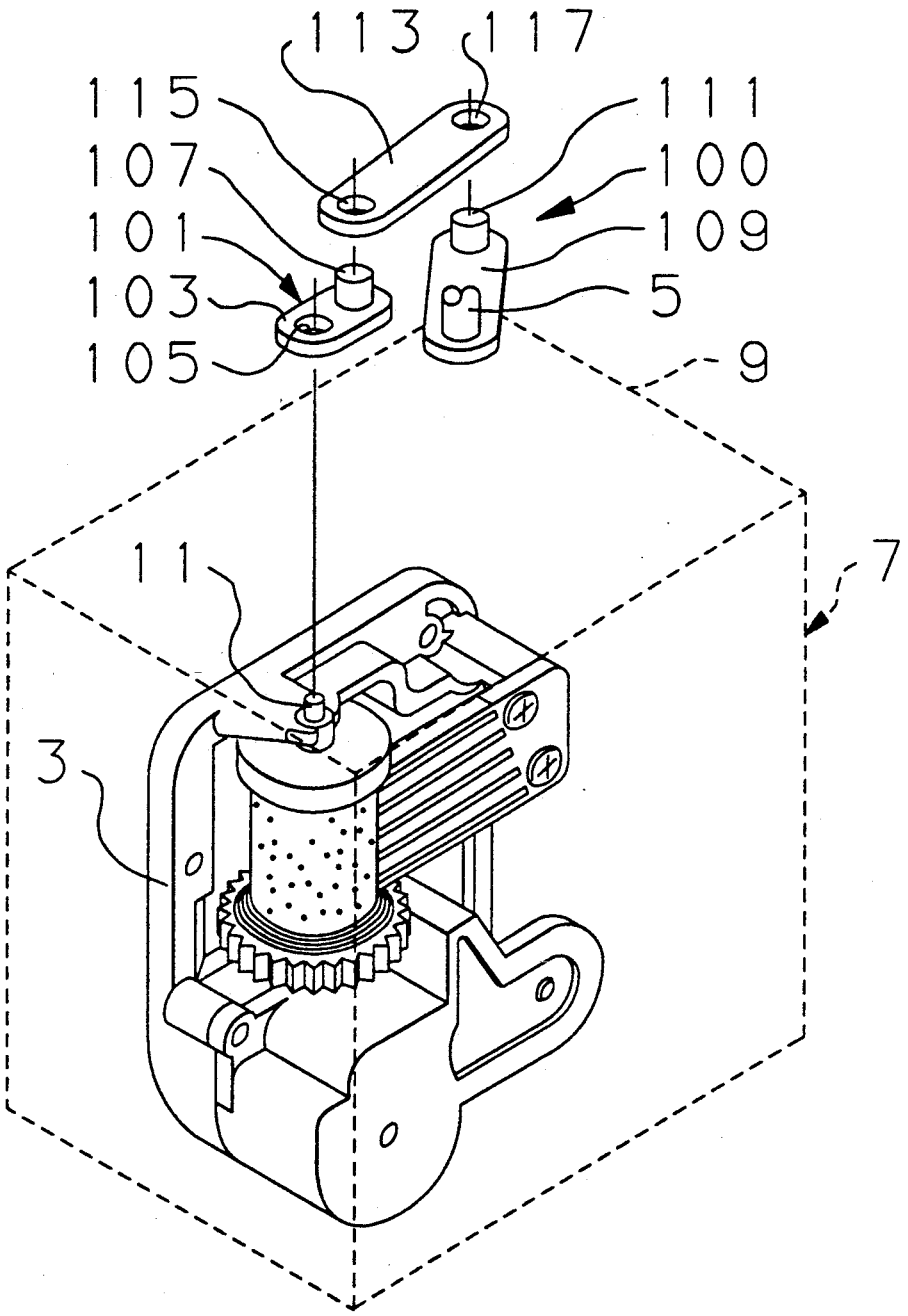
FIG. 3 is a perspective view similar to that of FIG. 1, but depicting in exploded view, an oscillating mechanism according to a preferred embodiment of the invention.

The invention overcomes the nonuniform oscillating movement produced by conventional mechanism 1 in a manner which shall now be described with reference to FIG. 3. As shown, there is provided an oscillating mechanism 100 according to a preferred embodiment of the invention. Mechanism 100 may be utilized with previously described music box mechanism 3 provided with power output shaft 11 and disposable within housing 7 having top wall 9.

Oscillating mechanism 100 includes a cam assembly 101 comprised of a cam plate 103 preferably of elongate configuration and provided with an aperture 105 at one end and a cam element 107 at its other end. Element 107 is preferably of a cylindrical configuration. Aperture 105 is sized for attachment to output shaft 11 in an appropriate manner so that rotation of shaft 11 shall cause rotation of element 107 about the axis of rotation of shaft 11. An elongate cam follower arm 109 is provided with a cylindrical pivot pin 111 at one end thereof, and the lower end of tappet rod 5 is secured to the other end of arm 109. Mechanism 100 further includes an elongate connecting rod 113 provided with apertures 115 and 117 at its opposite ends for pivotal engagement by cam element 107 and pin 111, respectively. The pivotal connection between rod 113 and element 107 defines a first pivot axis, and the pivotal connection between rod 113 and pin 111 defines a second pivot axis.

Figure 4:
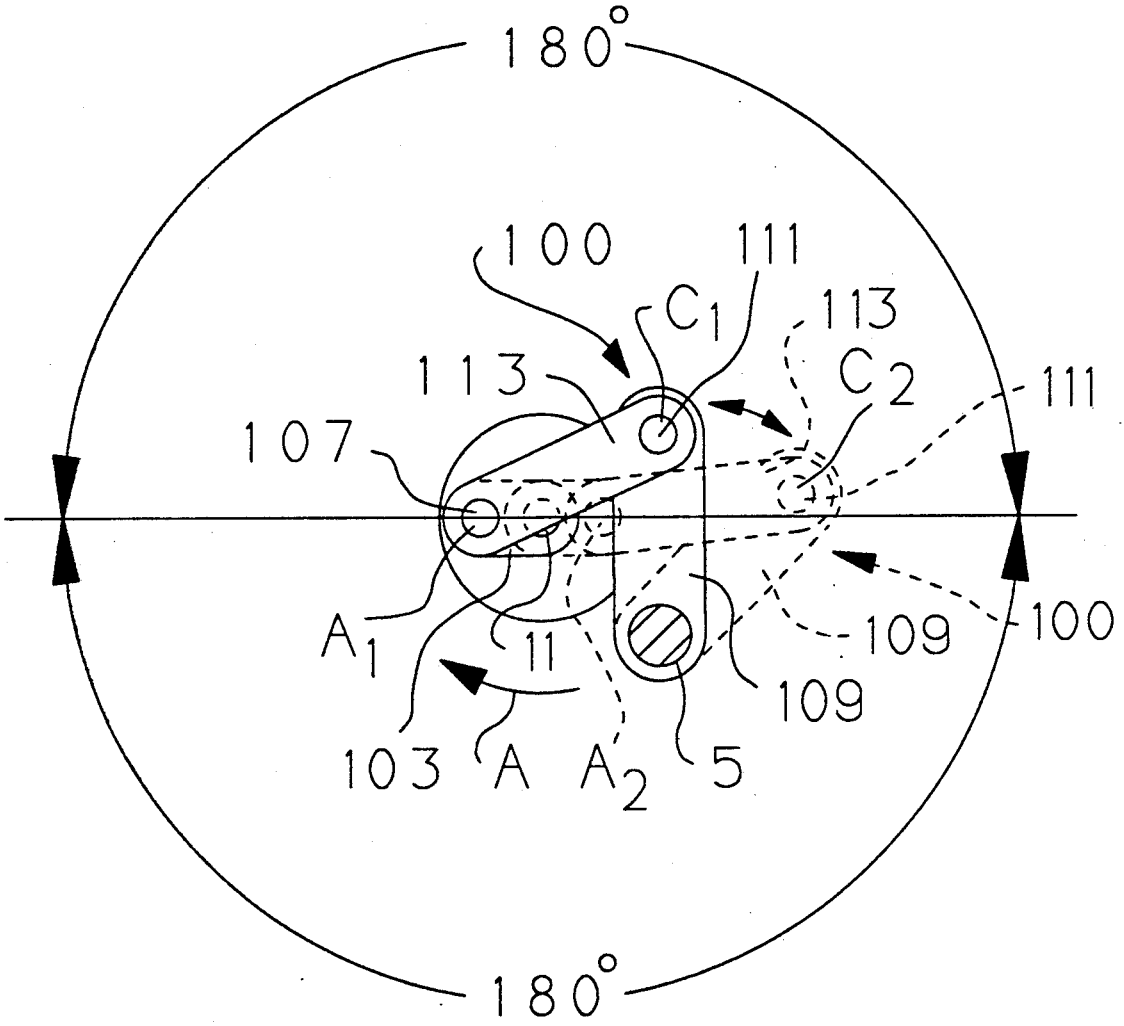
FIG. 4 is a top view of the oscillating mechanism shown in FIG. 3 in assembled form and depicting the geometric relationship between the components of the mechanism in producing the oscillating movement.

Mechanism 100 in its assembled form, is shown in FIG. 4, which also depicts the nature and geometric configuration of its operation, and the oscillating movement imparted thereby to tappet rod 5, the latter being journalled for rotation through wall 9 of housing 7 by means of any appropriate journal bearing or sleeve assembly well known in the art.

Mechanism 100 is shown in its two extreme positions of operation, as depicted in solid and phantom lines. These positions are indicated as $A_1$, $A_2$ and $C_1$, $C_2$, which indicate the respective terminal points of the oscillating movement for cam element 107 and pivot pin 111, respectively. During rotation of cam plate 103 about the axis of drive shaft 11 in the clockwise direction indicated by arrow A, cam element 107 is translated from point $A_1$ to point $A_2$ and pivot pin 117 is translated from point $C_1$ to point $C_2$, which in turn oscillates tappet rod 5 through arm 109 in a clockwise direction to an extent corresponding to the spacings between $A_1$, $A_2$ and $C_1$, $C_2$ for the forward half of an oscillation. In this position, cam plate 103 and connecting rod 113 are disposed with their longitudinal axes disposed substantially linear. Continued rotation of cam plate 103 in the clockwise direction brings cam element 107 from point $A_2$ back to point $A_1$ and pivot pin 111 from point $C_2$ back to point $C_1$, thereby causing a reverse or counterclockwise rotation of tappet rod 5 through arm 109, and thus completing the return half of the oscillation.

It is important to note that the geometric configuration of the invention assures that both the forward and return halves of a complete oscillation imparted to rod 5 by mechanism 100 occurs at the same speed and over the same time interval so that an ornamental object supported on rod 5 is caused to oscillate in the same corresponding manner. In this way, a uniform and balanced oscillating movement to the object is made possible by the invention so that no differential speed variations will be observed in an ornamental object oscillated thereby. The degree of oscillation can of course be changed by varying the dimensions of cam plate 103, connecting rod 105 and follower arm 109.

Figure 5:
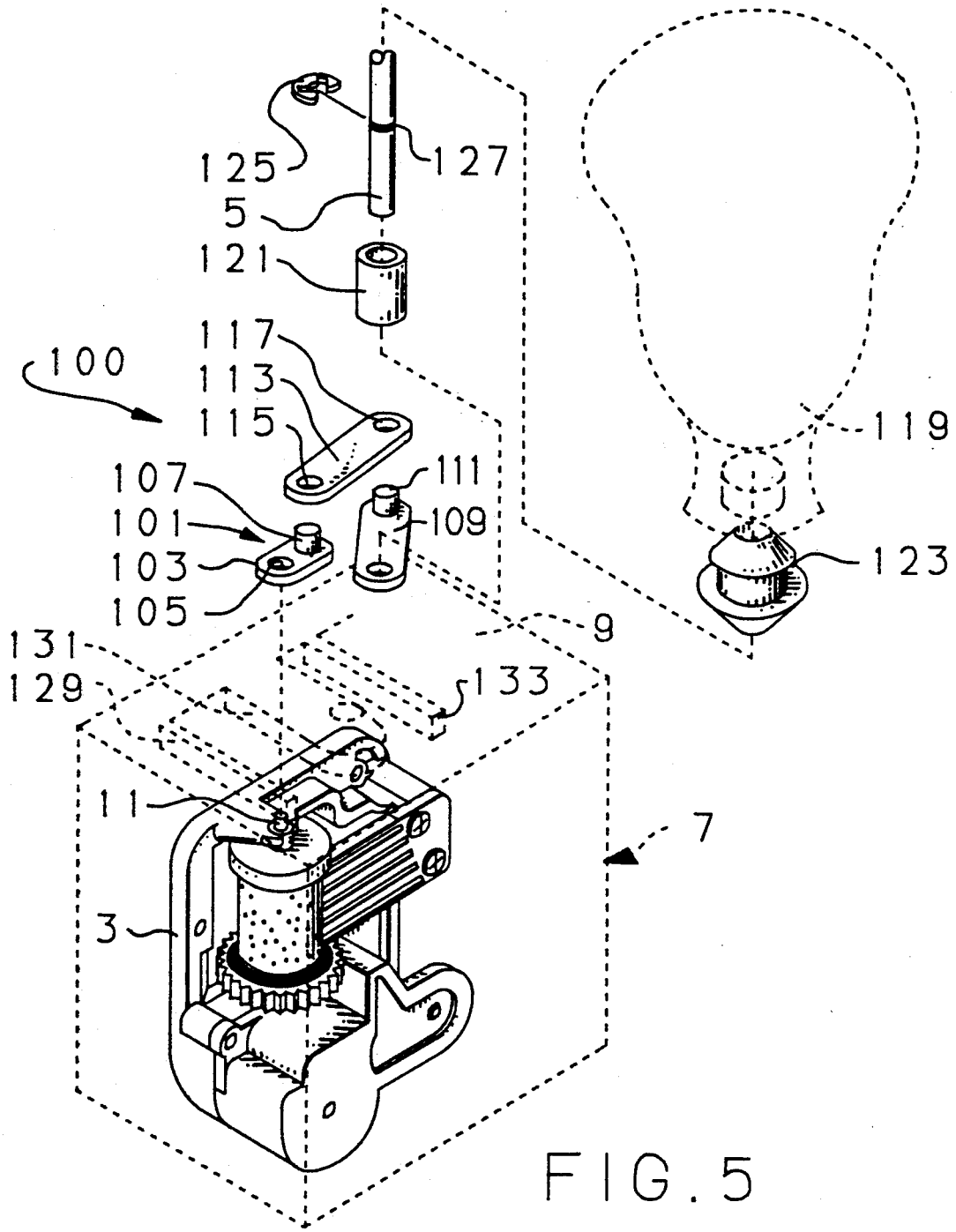
FIG. 5 is an exploded, perspective view similar to FIG. 3, but showing a second embodiment of the invention.
Figure 6:
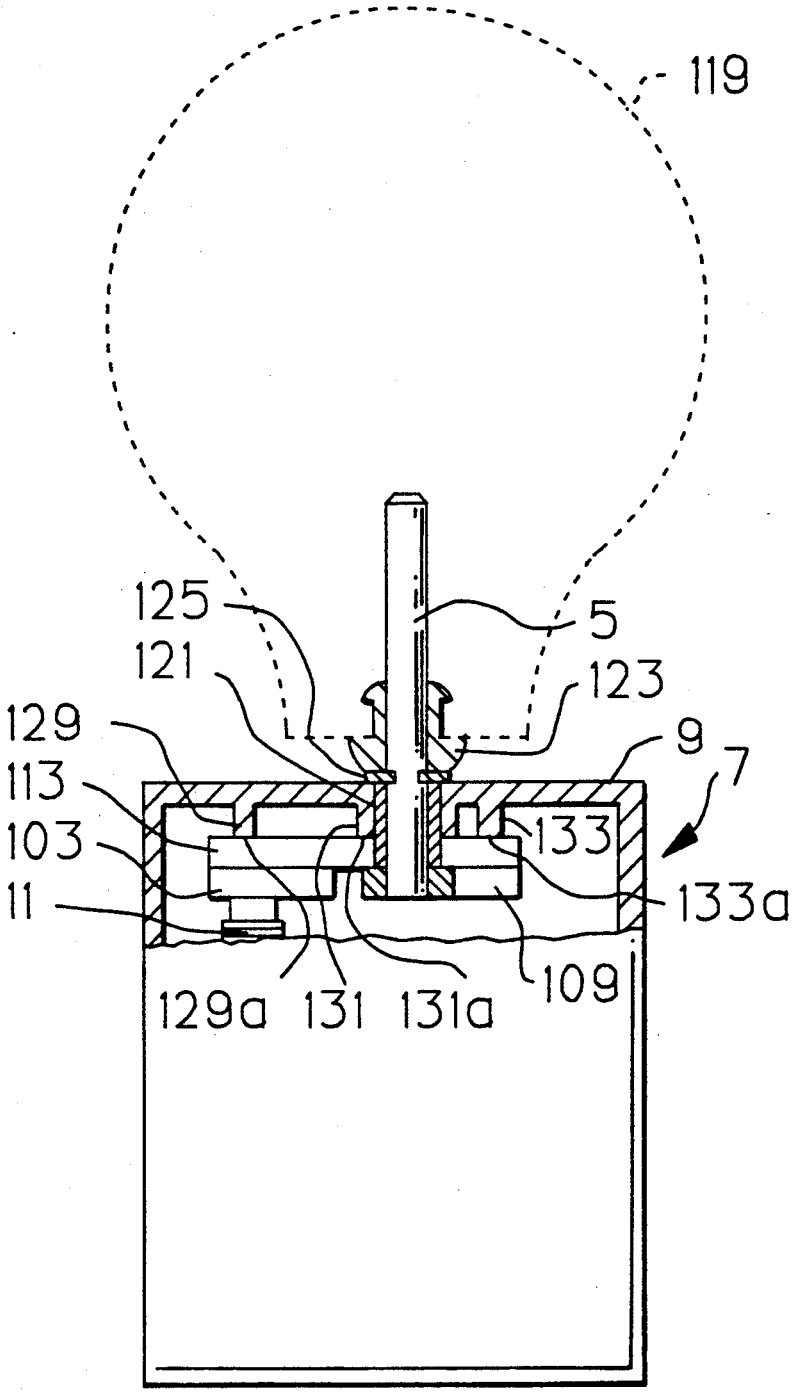
FIG. 6 is a side view, partially broken away, of the embodiment of the invention shown in FIG. 5.
Figure 7:
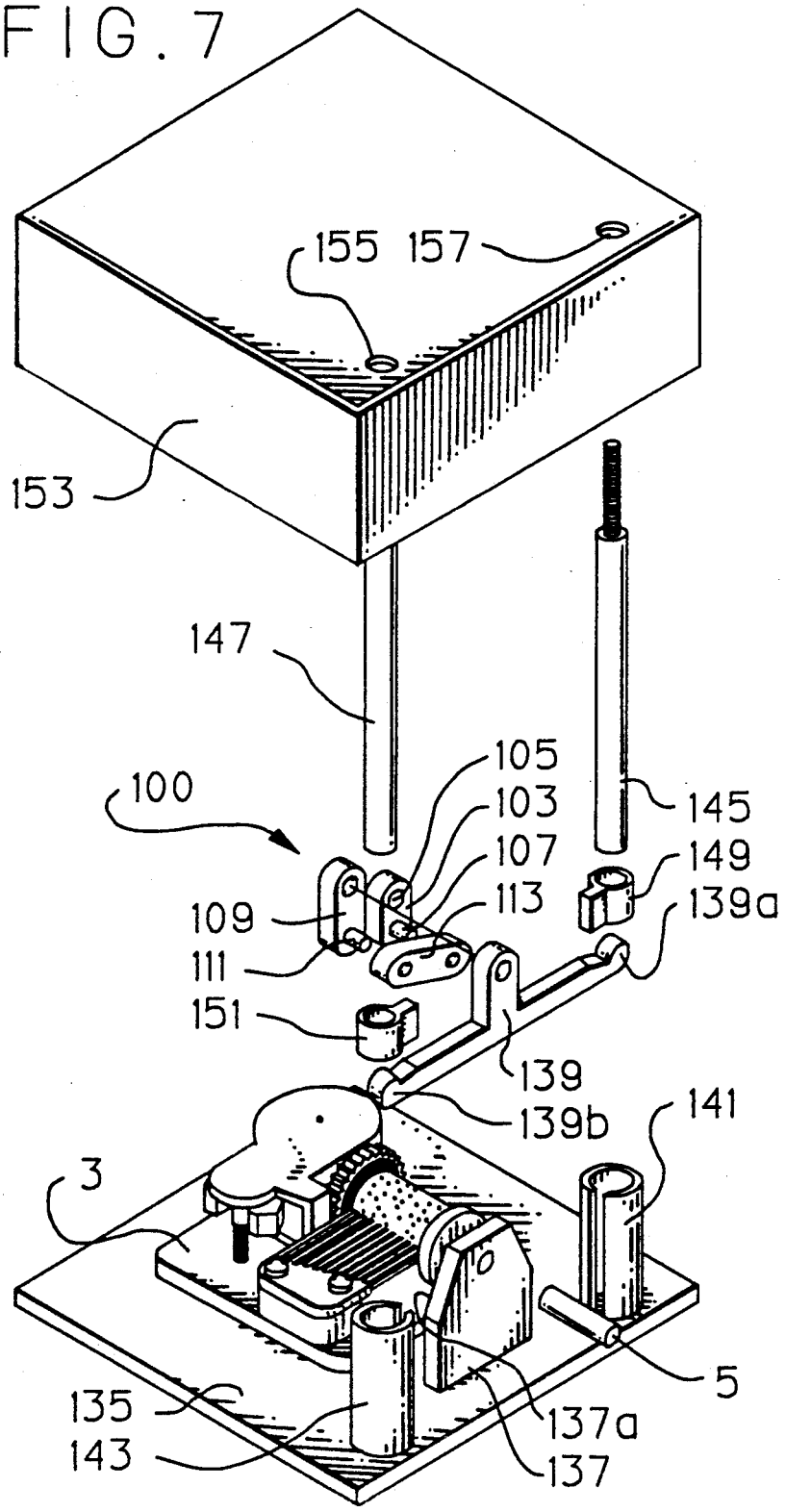
FIG. 7 is a partial, exploded, perspective view of a third embodiment of the invention.

In FIGS. 5 and 6, the tappet rod 5 is shown extending through an upper wall 9 of housing 7 and having an ornamental object 119 attached thereto. The attachment between the ornamental object 119 and the tappet rod 5 is a frictional attachment such that the ornamental object 119 normally oscillates with the tappet rod 5. However, should the oscillating movement of the ornamental object 119 be impeded by any reason, the frictional attachment will generate insufficient force to prevent oscillating motion of the tappet rod 5, thereby preventing any damage to the cam mechanism 100.

The tappet rod 5 is rotatably supported through the housing wall 9 by bushing 121 such that a first end portion extends into the interior of the housing 7 and engages cam follower arm 109. The frictional attachment comprises a rubber bushing 123 that is frictionally retained between the ornamental object 119 and the tappet rod 5. Frictional bushing 123 has an upper portion that is inserted into the ornamental object 119 and defines a central opening which slides over the exterior surface of the tappet rod 5. Tappet rod 5 is retained in its axial position by a "C" clip 125 inserted into a groove 127 defined in the periphery of the tappet rod 5 in known fashion. Although fabricating the friction bushing 123 out of rubber has been found to be satisfactory quite obviously it is possible to fabricate this element out of other materials without exceeding the scope of this invention.

The upper housing wall 9 defines one or more inwardly extending ridges which define a bearing surface that is in sliding contact with a surface of connecting rod 113. As illustrated in FIGS. 5 and 6, housing wall 9 defines ridges 129, 131, and 133 having bearing surfaces 129*a*, 131*a* and 133*a*, respectively. The sliding contact of these bearing surfaces with the connecting rod 113 promotes the stability of the various members of the cam assembly during their operation, thereby further preventing any inconsistent movement during the operation of this mechanism.

The cam mechanism according to the invention may also be used to impart up and down translational movement to an ornamental object, as illustrated by FIGS. 7–10. The music box mechanism 3 is attached to a base portion 135 of housing 7 such that the rotation axis of the output shaft 11 extends in a generally horizontal direction. The cam mechanism is exactly the same as that described in the previous embodiments and is similarly connected to tappet rod 5 which is journalled for oscillating movement in support member 137 extending upwardly from the base portion 135. Surface 137*a* of the support member 137 comprises a bearing surface that is in slidable contact with a surface of connecting rod 113. The sliding contact between these elements again, promotes stability during the operation of the cam mechanism.

A rocker arm 139 is attached to the tappet rod 5 such that it will oscillate with the tappet rod. Although rocker arm 139 is illustrated as having two arm portions, 139*a* and 139*b*, extending generally perpendicular to the longitudinal axis of the tappet rod 5, it is to be understood that a rocker arm having a single arm portion may be utilized without exceeding the scope of this invention.

Figure 10:
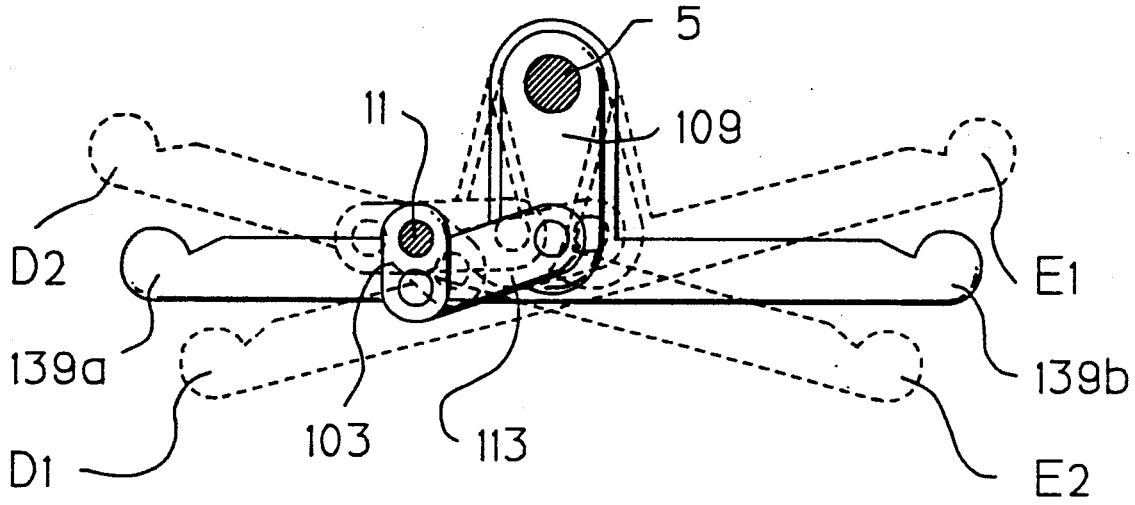
FIG. 10 is a partial, front view of the mechanism shown in FIGS. 7–9 illustrating the positions of the rocker arm.

As illustrated in FIG. 10, the oscillating movement of tappet rod 5 will also cause the rocker arm 139 to oscillate such that arm portion 139*a* moves between extreme positions $D_1$ and $D_2$, while arm portion 139*b* moves between its extreme positions $E_1$ and $E_2$. The movement of these elements between their extreme points will be at a constant speed due to the use of the cam mechanism according to the invention.

Figure 8:
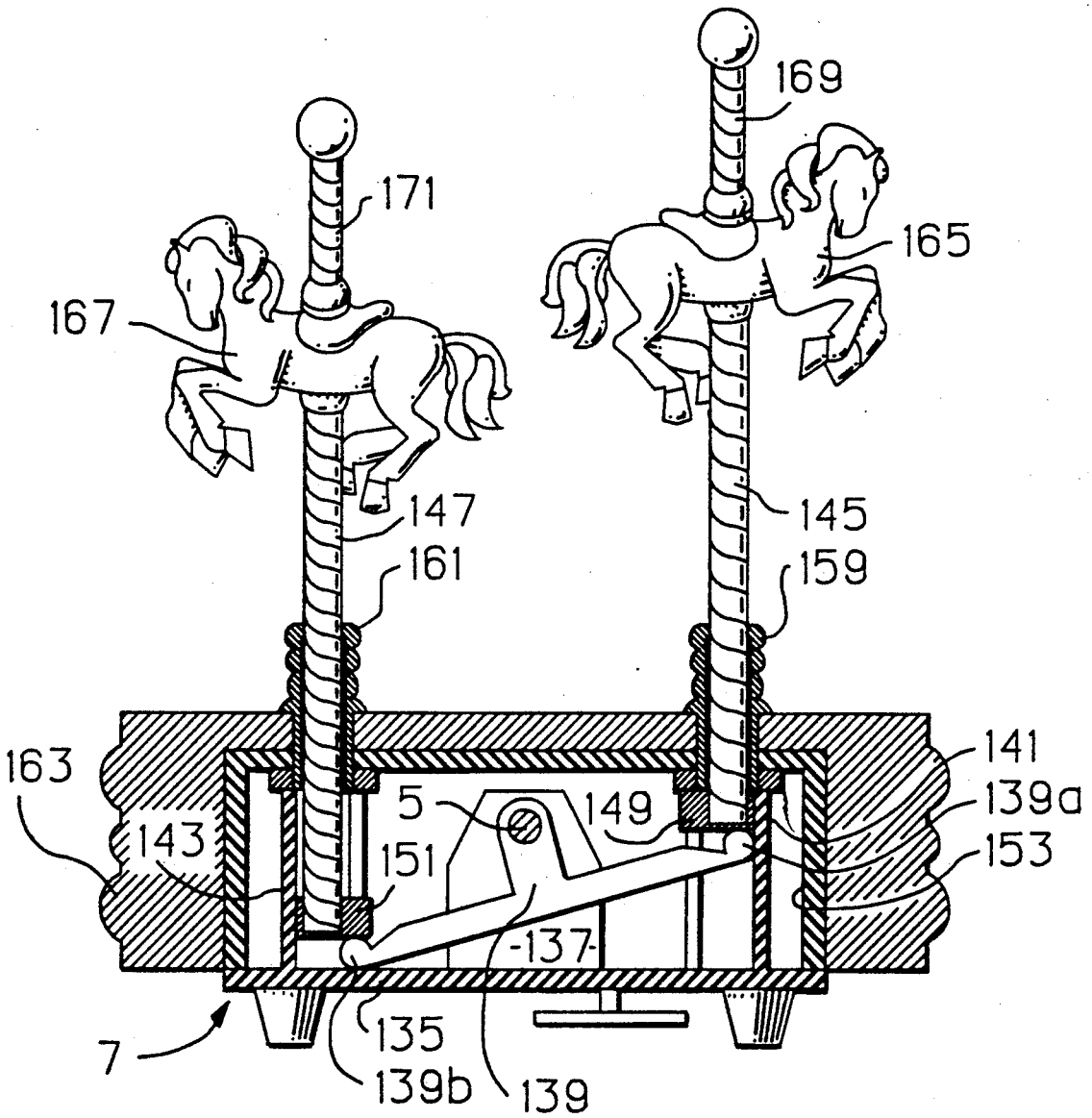
FIG. 8 is a view, partially broken way, of the embodiment of the invention shown in FIG. 7.
Figure 9:
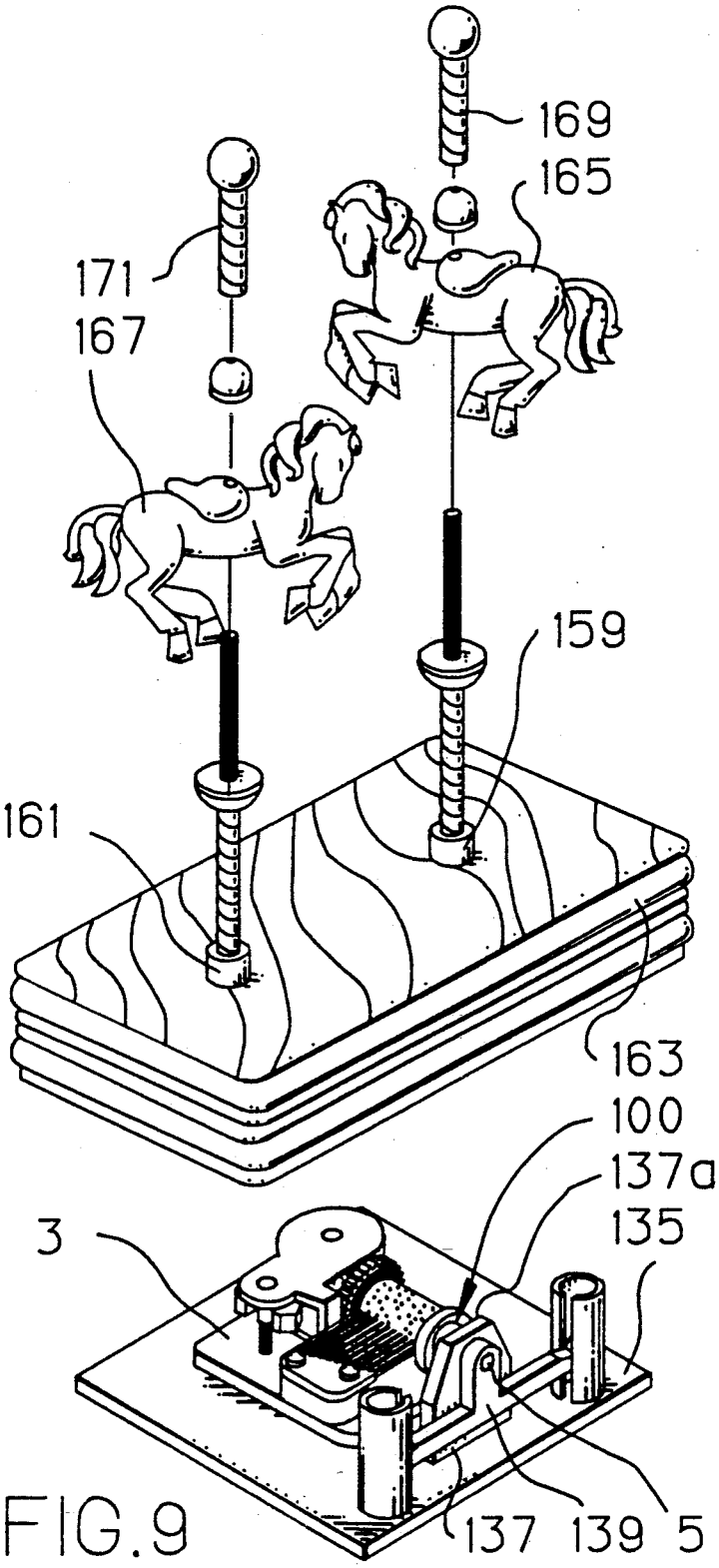
FIG. 9 is an exploded, perspective view of a the embodiment of the invention shown in FIGS. 7 and 8.

Guide posts 141 and 143 extend upwardly from the base portion 135 and each define a hollow interior opening to slidably accommodate actuating rods 145 and 147. A first end of each of the actuating rods extends into the respective guide post and bears against an arm portion of the rocker arm 139 as best illustrated in FIG. 8. Actuating rod ends 149 and 151 may be attached to the first ends of the actuating rods so as to provide a larger bearing surface for contact with the rocker arm portions. Each of the guide posts 141 and 143 define a laterally opening longitudinal slot to accommodate the rocker arm portions 139*a* and 139*b* as well as a portion of the actuating rod ends 149 and 151. Laterally extending portions of the actuating rod ends also extend through the slot defined by the guide posts to prevent any rotation of the actuating rods.

Thus, as can be seen in FIG. 8 oscillation of the rocker arm 139 will cause the actuating rods 145 and 147 to translate in a generally vertical direction along their longitudinal axes in a smooth, uniform speed motion.

A housing cover portion 153 encloses the music box mechanism 3, the cam mechanism 100, the rocker arm 139 the tappet rod 5 as well as the guide posts 141 and 143. Portions of the actuating rods 145 and 147 extend to the exterior of the cover portion 153 through openings 155 and 157 defined in an upper portion of the cover.

Bushings 159 and 161 may be attached to the cover portion 153 so as to slidably guide the actuating rods 145 and 147 during their translational movement.

A decorative exterior cover 163 may be placed over the housing 7 to provide an aesthetically pleasing effect. Decorative objects 165 and 167 are placed over the exterior ends of actuating rods 145 and 147 and are retained in place by decorative caps 169 and 171. As can be readily seen, translational movement of the actuating rods 145 and 147 will impart a similar movement to the decorative objects 165 and 167.

It is to be understood that the form and configuration of the invention herein shown and described is to be taken as a preferred example or embodiment thereof, and that various changes in shape, material, size and arrangement of parts may be resorted to without departing from the spirit of the invention or scope of the subjoined claims.

What is claimed is:

1. A mechanism for imparting a smooth and balanced oscillating movement to a tappet rod, which mechanism comprises:
   a) a music box mechanism for producing music and including a rotating power output shaft;
   b) a tappet rod journalled for oscillation; and,
   c) a cam assembly operatively interposed between the power output shaft and the tappet rod such that the tappet rod oscillates about an axis between extreme points of oscillation, the cam assembly comprising: a cam plate provided with a cam element thereon, the cam plate attached to the power output shaft so as to rotate therewith; a cam follower arm secured to the tappet rod; a connecting rod having one end pivotally connected to the cam element to define a first pivot axis therewith and another end connected to the cam follower arm to define a second pivot axis therewith, such that the first and second pivot axes translate between respective first and second positions during rotation of the power output shaft to define the extreme points of oscillation of the tappet rod whereby the oscillation occurs at the substantially uniform speed.

2. The mechanism of claim 1 wherein the cam plate is of elongate configuration, with one end of the cam plate being connected to the power output shaft and the cam element being carried on an other end of the cam plate.

3. The mechanism of claim 1 further comprising a bearing surface in sliding contact with the connecting rod.

4. The mechanism of claim 3 wherein the bearing surface is defined by a ridge member extending inwardly from the housing.

5. The mechanism of claim 1 further comprising:
   a) an ornamental object; and,
   b) means frictionally attaching the ornamental object to the tappet rod such that the ornamental object will normally oscillate with the tappet rod, but if the oscillation motion of the ornamental object is impeded, the tappet rod will continue to oscillate.

6. The mechanism of claim 5 wherein the frictional attaching means comprises a bushing attached to the tappet rod and to the ornamental object.

7. The mechanism of claim 6 wherein the frictional attaching bushing is made of rubber.

8. The mechanism of claim 1 further comprising a rocker arm attached to the tappet rod so as to oscillate therewith.

9. The mechanism of claim 8 wherein the rocker arm has at least one arm portion extending generally perpendicular to a longitudinal axis of the tappet rod.

10. The mechanism of claim 9 further comprising a) a housing base portion; and, b) a housing cover portion located on the housing base portion so as to completely enclose the music box mechanism, the cam assembly, the tappet rod and the rocker arm.

11. The mechanism of claim 10 further comprising:

a) at least one actuating rod having a first end disposed interiorly of the housing cover portion and a second end disposed exteriorly of the housing cover portion;

b) means supporting the actuating rod such that it may undergo only translational movement in a direction generally parallel to its longitudinal axis; and, c) means operatively interconnecting the rocker arm and the actuating rod such that oscillation of the rocker arm causes translational movement of the actuating rod.

12. The mechanism of claim 11 wherein the means supporting the actuating rod comprises:

a) a guide post located on the housing base portion and defining an opening dimensioned so as to slidably accept the first end portion of the actuating rod; and b) a bushing attached to the housing cover portion and slidably bearing against the actuating rod.

13. The mechanism of claim 10 further comprising a support member extending from the housing base portion for supporting the tappet rod for oscillating motion.

14. The mechanism of claim 13 further comprising a bearing surface defined on the support member and slidably contacting the connecting rod.

15. The mechanism of claim 11 further comprising an ornamental object attached to the actuating rod exteriorly of the housing cover portion.

* * * * *